US005829202A

United States Patent [19]

Canton Gongora et al.

[11] Patent Number: 5,829,202

[45] Date of Patent: Nov. 3, 1998

[54] SYSTEM OF INTERNAL MODULAR STRUCTURES CREATING AN OFFICE ENVIRONMENT

[75] Inventors: Antonio Canton Gongora; Carlos Jesus Cruz Fernandez; Jose Maria Muñagorri Enriquez; Juan Carlos Rayo Ortigüela, all of Madrid, Spain

[73] Assignee: Telefonica de España, S.A., Madrid, Spain

[21] Appl. No.: 752,346

[22] Filed: Nov. 19, 1996

[30] Foreign Application Priority Data

May 20, 1996 [ES] Spain ..... 9601116
May 31, 1996 [ES] Spain ..... 22245

[51] Int. Cl.[6] ..... A47F 10/00; E04H 1/12

[52] U.S. Cl. ..... 52/36.1; 52/28; 52/36.2; 52/79.4; 52/79.5; 52/239

[58] Field of Search ..... 52/28, 36.1, 36.2, 52/79.4, 79.5, 239; 40/606

[56] References Cited

U.S. PATENT DOCUMENTS

| | | | |
|---|---|---|---|
| 4,146,287 | 3/1979 | Jonsson | 52/28 X |
| 4,177,612 | 12/1979 | Tochihara | 52/36.1 X |
| 4,471,586 | 9/1984 | Shuch et al. | 52/36.2 |
| 4,980,998 | 1/1991 | Amstutz et al. | 52/28 |
| 5,655,822 | 8/1997 | Roberts et al. | 52/36.1 X |

*Primary Examiner*—Christopher Kent
*Attorney, Agent, or Firm*—Reid & Priest LLP

[57] ABSTRACT

A system of internal structuring of establishments for the marketing of telecommunications services, consisting of a group of elements configuring a commercial establishment contemplating the repetitive succession of a number of identical porticos which structure the usable space of the premises, the porticos consisting of columns and illuminating beams supported thereon, to which different modules structuring divisions by areas or modes of attention to clients are incorporated, with identification of a cabinet, a zone for presentation of services, a zone for promotion of services or emphasis thereon, a zone or area for experimentation, a zone for assistance or information, an area of personalized attention to clients and an area for exhibition of available equipment.

9 Claims, 17 Drawing Sheets

SYSTEM OF INTERNAL MODULAR STRUCTURES CREATING AN OFFICE ENVIRONMENT

BACKGROUND OF THE INVENTION

1. Field of the Invention

The present invention relates to a system of internal structuring applicable to establishments for the marketing of telecommunications services. This invention finds application in the industry engaged in the manufacture of structuring systems and erection of commercial premises.

2. Related Art

The promotion and sale of terminals and products has so far been the priority function of the majority of commercial premises in the telecommunications sector.

The structuring of said offices also depends on the type and size of the premises. There is no similarity whatsoever between the smallest and the largest or most important of said shops. The largest become large supermarkets of telecommunications products, and even stores of the same size are configured differently, as dictated by the specific premises they occupy or even by the city of location.

Traverses of such premises do not yield the results that most clients would desire, and there is no segregation by areas of the products being offered for sale. This causes some confusion among clients.

Telecommunications equipment shops need to offer for sale those new services which appear rapidly in the market but are in most cases unknown to the general public. It is therefore necessary to restructure such shops so as to offer the full range of telecommunications services, not only the sale of terminals.

Such restructuring should be based on experimentation by clients, with several points of potential sale being assigned to said purpose. The system should also be modular, so as to make it reasonably independent of the size and other characteristics of the premises.

In this manner, all the establishments of one same operator will be structured similarly and possess similar images. This will make it easy for clients to ask questions at any of said shops, as a client who has explored any one of them will easily be able to find his way in all others.

The present applicant has no knowledge of the existence of any system of internal structuring applicable in establishments for the marketing of telecommunications products which is even approximately endowed with the characteristics indicated above.

SUMMARY OF THE INVENTION

The system of internal structuring of establishments for marketing telecommunications services proposed by the present invention is a novelty in this field and many others, as its incorporation will make it easy to identify the shop, regardless of location.

More specifically, this system provides a global, integrated solution of the problem posed, as it solves the aspects of configuration of space and lighting and is ideally suited for the sale of telecommunications services.

The system consists of a repeated series of porticos structuring the space available in the premises.

Said porticos are formed by two basic elements, to wit:

The columns.

The illuminating beams.

Different modules, in accordance with the function to be performed, are incorporated to the above elements.

The column serves to support the porticos, and a support for a monitor and/or a pamphlet dispenser may be added thereto.

The illuminating beam is a modular element repeated as many times as necessary, as dictated by the desired width of the portico, among the columns serving as supports.

The illuminating beams contain the lighting system of the premises: the ambient lighting, and the spot lighting used to emphasize certain areas and panels.

The following modules may be added to configure the shop in accordance with the functionality desired:

Panel for presentation of services.

Panel for emphasis.

Spot for exploration/experimentation.

Post for attention to the client.

Post for assistance.

The panel for presentation of services comprises a self-lighted swiveling panel capable of holding posters on two sides, with a zone for incorporation of a monitor, a keyboard for managing the information presented on the monitor, and a pamphlet dispenser support.

The panel for emphasis comprises a panel capable of holding posters on two sides, used to emphasize the services exposed on the above panel.

The post for exploration and experimentation comprises a table with a computer and an additional monitor which will have the double function of serving as a repeater of the operations performed on the computer, or showing explanatory videos. This module shall enable clients to experiment with the services offered by the shop.

The module located in the area for attention to clients, in which clients may solve specific problems, will be partially enclosed by a screen.

The post for assistance shall be used to inform and orient clients. It will be located in the focal point of the shop and is to be capable of making sales.

A logotype panel supporting the corporate image of the owner will also be located in said focal point.

The following are also included as elements of the modules:

Equipment showcase.

Monitor support.

Directory.

Equipment showcase in the facade.

The equipment showcase or module for exhibition of available equipment is an element designed to expose or exhibit the equipment offered for sale.

The monitor support consists of a support, located near the facade, for several monitors, to permit services and products to be shown through action from the exterior.

The directory is a module incorporating the labels of the various brands of the shop owner. It is located at the exterior, near the entrance.

The equipment showcase in the facade will hold the selected equipment to be shown in the cabinet.

Selective utilization of these modules will permit different configurations, in accordance with the type of premises, the range of products or services available, the type of service to be emphasized, and the messages to be transmitted, in accordance with the day or night schedule, etc.

It therefore affords perfect adaptation to the factors and circumstances affecting the installation of a commercial establishment with these characteristics.

Use of these modules causes the commercial establishment to be structured in seven different areas, classified by mode of attention to clients.

1. The cabinet, which gives a direct view of the equipment showcase in the facade and a global view of the shop, and permits information on the services and products offered by the shop, to be obtained.

2. The area of regular presentation of services (said term being self-explanatory, from which clients may have use of graphical and/or interactive materials so as to become familiar with the most important products and services being sold).

3. The area for emphasis on services, for extraordinary presentations promotions, special offers, discounts, long-term purchases, etc.

4. The area for experimentation, in which clients may be informed on the operation of the various services offered and may experience such services, by using them through scheduled demonstrations.

5. The area of assistance, located in the central focus of the shop and at which the logotype panel and the point for assistance and sale is to be found.

6. The area of attention to clients, where the latter obtain personalized attention and resolve questions of a technical or contractual nature.

7. The area of exposition of equipment, at which the equipment being marketed is exhibited.

This configuration by areas responds to the operating dynamics of the shop, directing clients' traverses of the establishment and leading them successively along the different areas thereof, in a logical process of decision to purchase.

In summary, a basic, simple traverse through the shop, in which clients are directed until they reach the end of the premises, at which the contracting of services and acquisition of products takes place.

The lighting, an important element of the system, is incorporated in four different forms or types:

1. Perimeter ambient lighting, based on floor-mounted spots and used to shade the vertical parameters.

2. Principal ambient lighting, integrated into the modules of the system and consisting of screened light from the beams that frame the porticos.

3. Spot lighting to highlight specific elements. Three types are foreseen:

Self-lighting of panels, to emphasize posters.

Light projectors in the system beams, to emphasize the posters and the demonstration posts.

Ceiling lighting at places such as the area for personalized attention, the area for attention to clients, and the reception showcase, in order slightly to increase the intensity of the lighting in each.

4. The cabinet, in order to create a curtain of light in front of the facade and thereby attract attraction.

The facade is a transparent surface covering the entire available frontage, in order to give a full view of the interior with the effect of depth obtained from a succession of lighted porticos and self-lighted colored panels.

The system in accordance with this invention and described herein is thus characterized by its modularity and flexibility, permitting its adaptation, through adequate use of the individual elements, to any type of surface, regardless of its dimension or physical characteristics.

A contribution is thereby made to increase the rapidity of installation and startup of the shop, extend a homogeneous image of the enterprise owning such shops, and considerably reduce installation costs, as different commercial premises are given a single solution.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
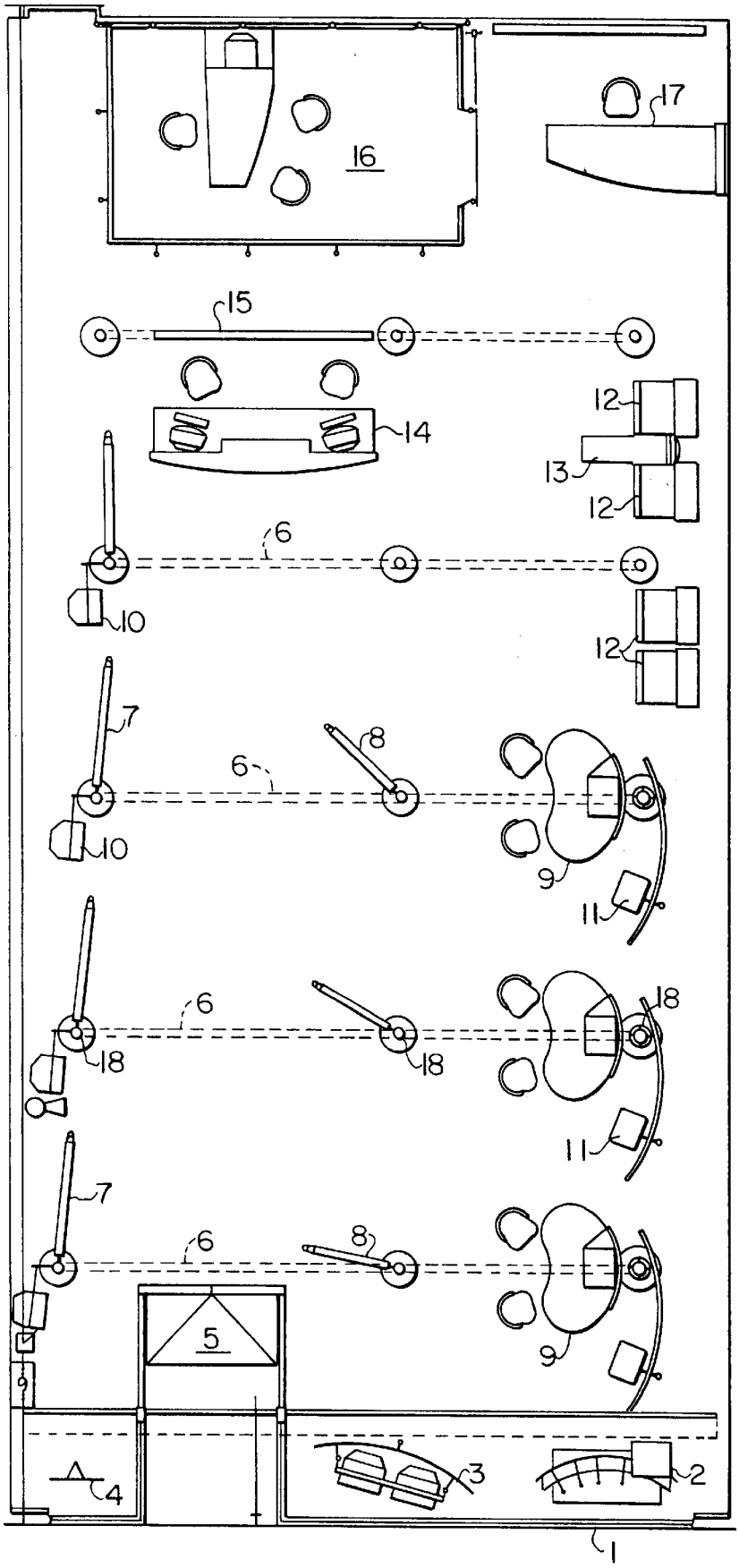
FIG. 1 shows the general configuration of a commercial establishment in accordance with the system of internal structuring applicable in the establishments for the marketing of telecommunications services object of the invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Examination of FIG. 1 will show the system of internal structuring applicable to establishments for the marketing of telecommunications services, with an overall view of a shop based on the invention, this FIG. 1 showing the different modules comprising the described structuring and the areas derived as a function thereof, and specifically, the entire shop, with the desired effect of depth, may be seen from the exterior and through the facade 1, with a priority view of the showcase in the facade 2 and the monitor support 3, and also of the directory 4, which is at the left of the entrance to the shop.

Proceeding to said entrance 5, the various porticos 6 are repeated, each with its normal configuration, i.e., panel for presentation of services 7, panel for emphasis 8, and post for experimenting 9.

Monitors on the columns 10 and at the curved panels of the posts for experimenting 11 have also been utilized in this realization.

The equipment showcases 12 may incorporate, between two of said modules, a module of connection 13 to lodge the connections necessary for operation of the equipment being shown.

The post for assistance 14 is in front of the logotypes panel 15, at the rear of the shop.

The post for personalized attention to clients 16 and the post for attention to clients or professional zone 17 are the final units of the various modules of the system described in this report.

It may be seen in this FIG. 1 how the repetitive succession of the series of porticos 6 structure the available space in the premises: they are configured with three columns 18, with the panel for presentation of services 7 at the left, the panel for emphasis 8 in the central part, and the post for experimentation at the right of each portico 6.

Figure 2:
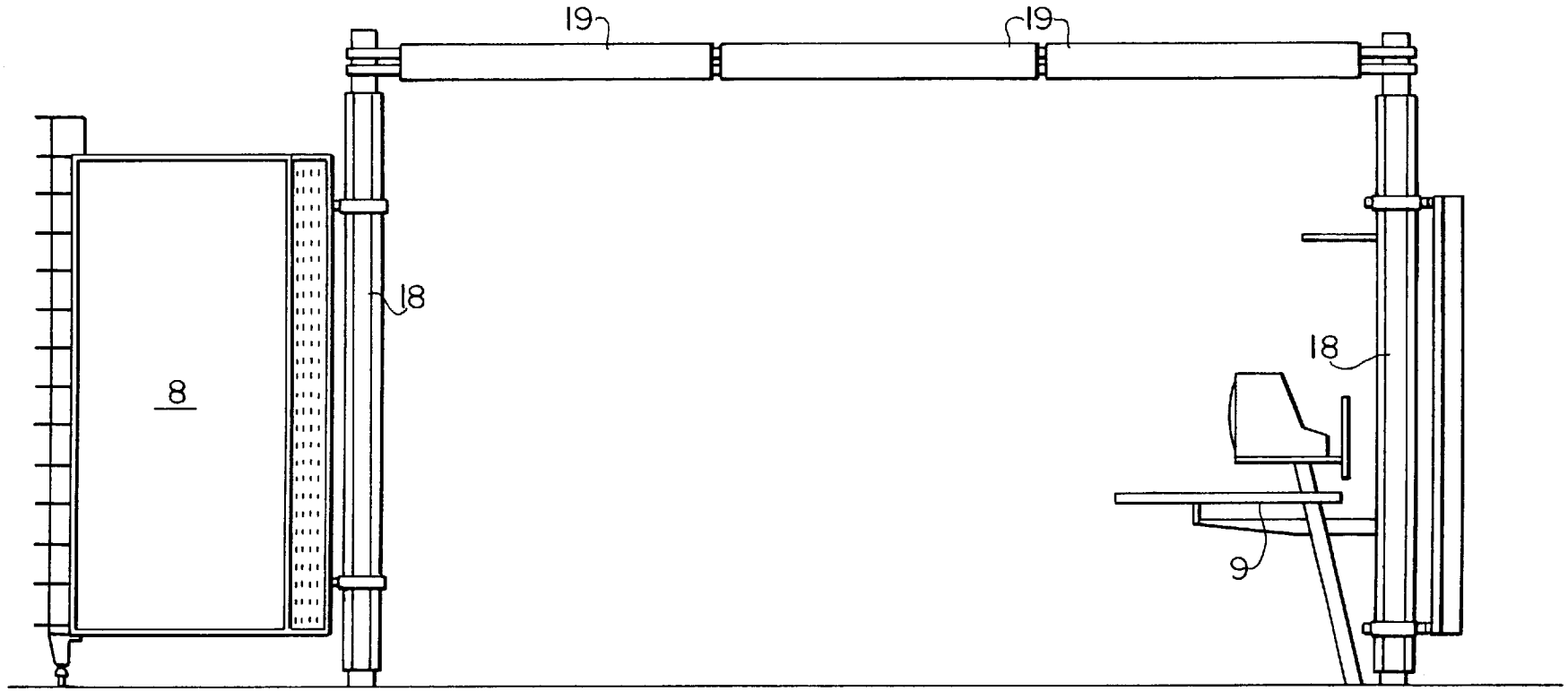
FIG. 2 shows the basic structural portico.

As shown in FIG. 2, the porticos 6 which are basic structures in this system are formed by two principal elements: the columns 18 and the illuminating beams 19.

The necessary units of columns 18 and illuminating beams 19 are used in accordance with the width of the portico 6.

Figure 3:
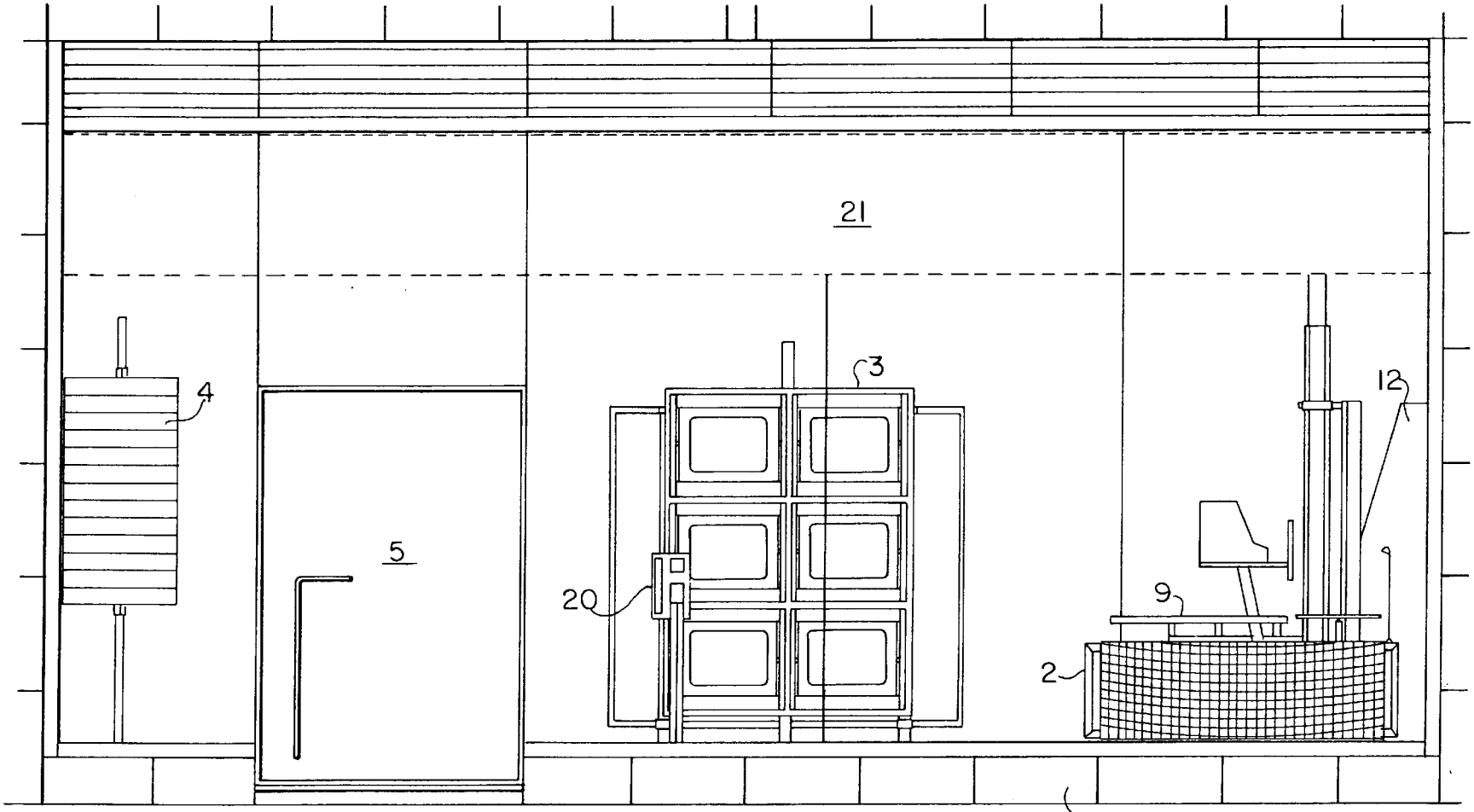
FIG. 3 is a general view of the facade and the cabinet.

FIG. 3 is a view of the shop from the facade 1, with identification of the directory 4, the entrance to the shop 5, the monitor support 3, adapted for six monitors, the keyboard 20 for interactivity from the exterior, the showcase 2 of equipment in the facade, a post for experimentation 9 in the first portico of the shop, and an equipment showcase 12, thereby giving an idea of the global image of the shop permitted by this layout.

The free zone 21 of this facade may be used to identify the shop owner and the shop.

Figure 4:
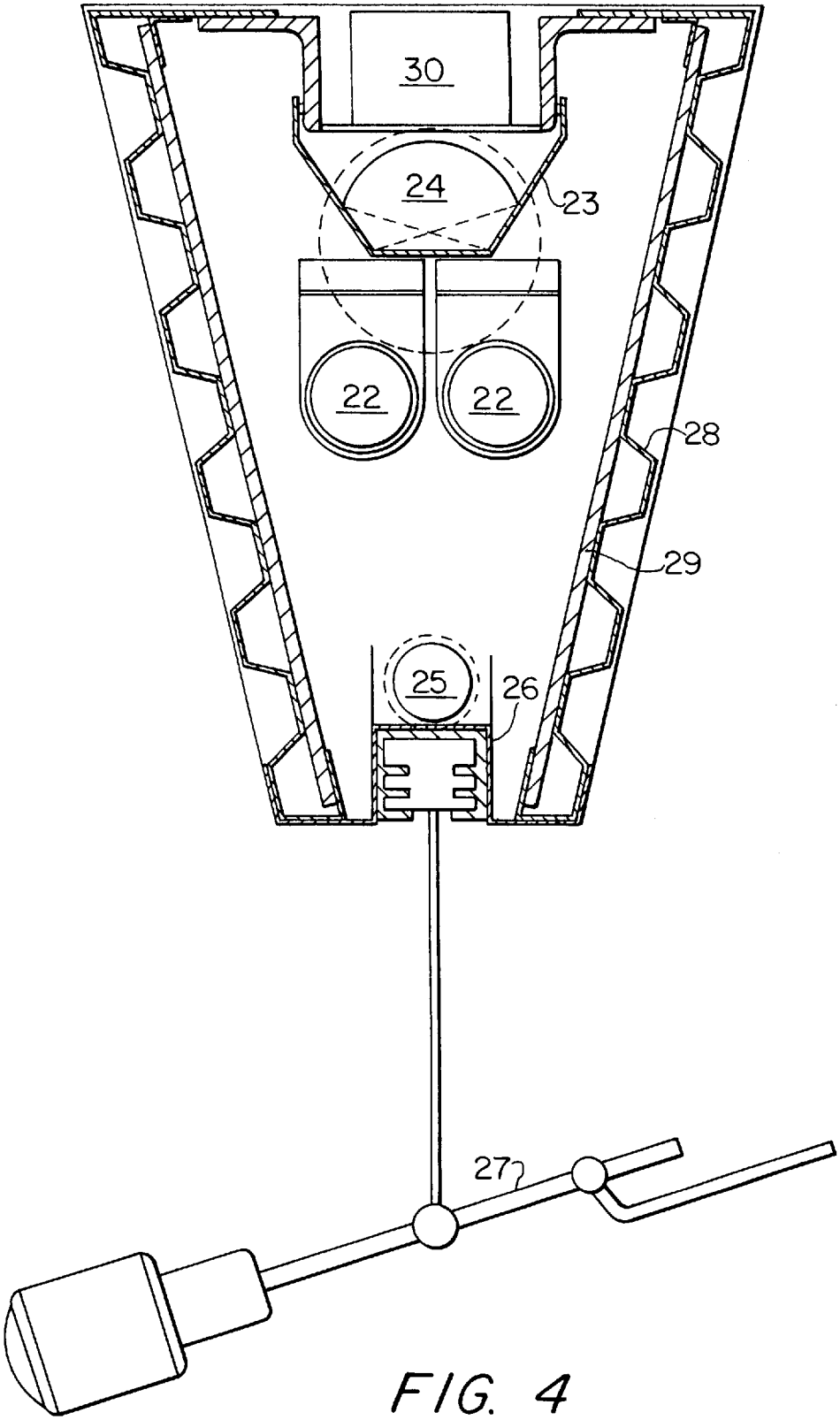
FIG. 4 shows the structure of the illuminating beam.

FIG. 4 shows a transverse section of a illuminating beam 19, with indication of the fluorescent tubes 22 and the electric channeling tray 23 enclosing the cabling between modules 24.

This illuminating beam 19 also contains in its lower part another zone for cabling between modules. while an electrified rail 26 permits connection of hanging projectors 27.

The walls of the illuminating beam 19 referred to above consist of a sheet of perforated aluminum 28 and two sheets of translucent methacrylate 29.

Figure 5:
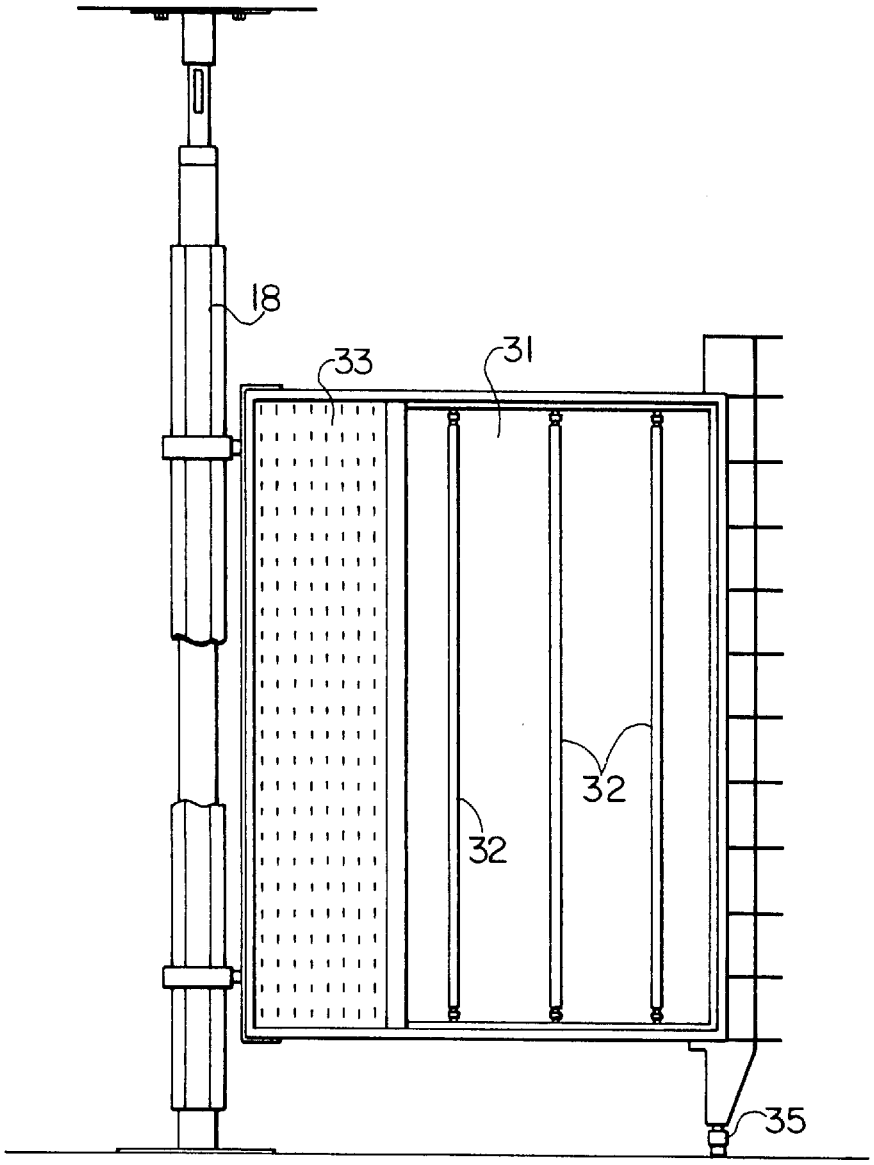
FIG. 5 is an elevation of a column with the services presentation panel attached.
Figure 6:
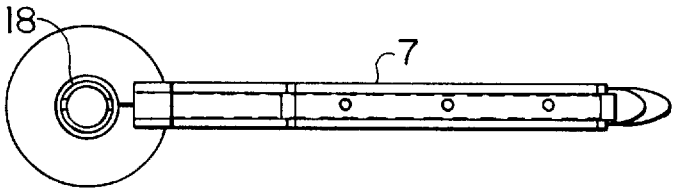
FIG. 6 is a plan view of the object shown in FIG. 5.

The reactance 30 of the illuminating beam 19 is placed in the upper part thereof In FIGS. 5 and 6, the panel for presentation of services 7 consists of two differentiated zones: a self-fluorescently-lighted panel 31 which holds posters on two sides, and a zone 33 for incorporation of a monitor and a support consisting of a pamphlet holder.

Figure 7:
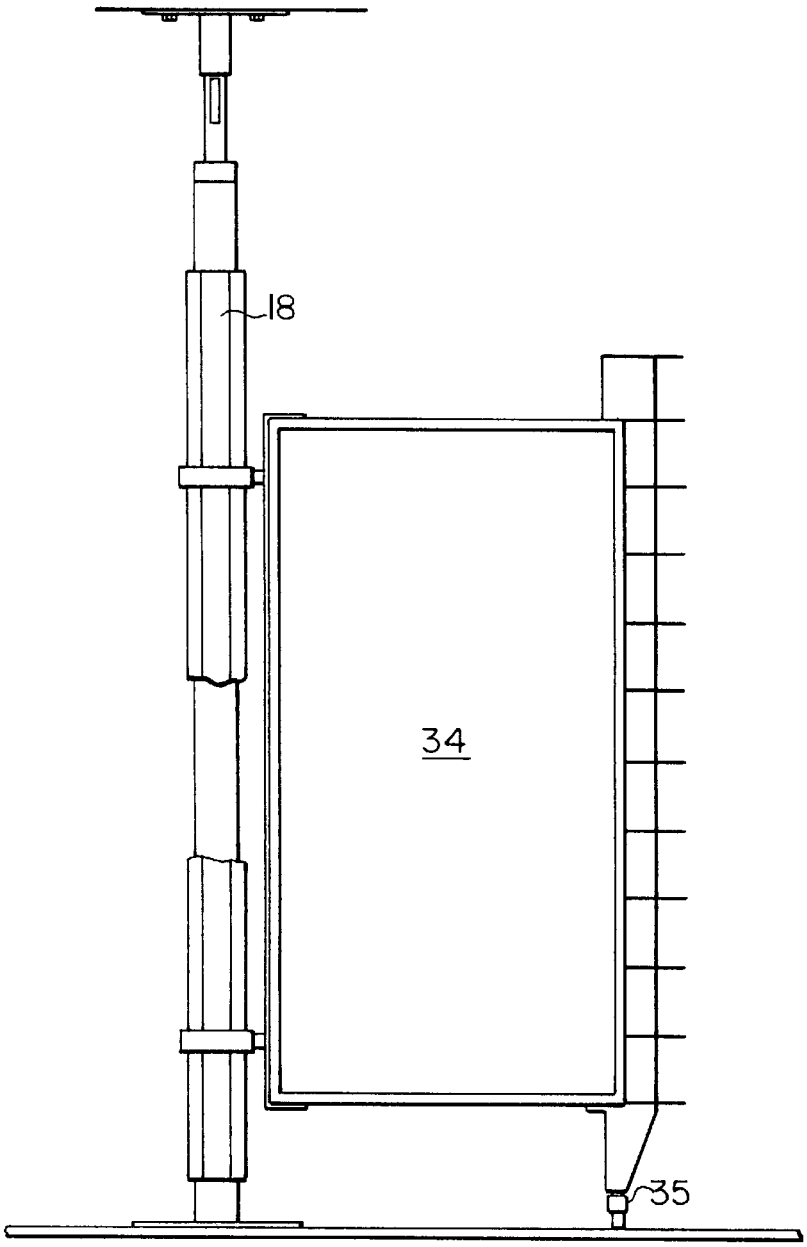
FIG. 7 is an elevation of a column with the services emphasizing panel attached.
Figure 8:
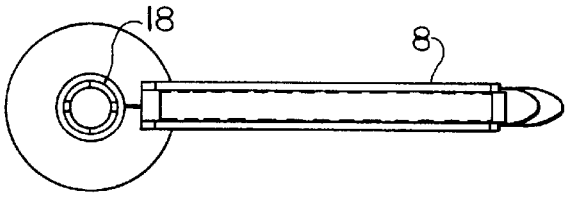
FIG. 8 is a plan view of the object shown in FIG. 7.

In FIGS. 7 and 8, the panel for emphasis 8 consists of a single zone 34 capable of holding posters on two sides.

Both the panel for presentation of services 7 and the panel for emphasis 8 swivel, and both are supported on wheels 35, and thereby permit a multiplicity of configurations, by simply modifying the angle of opening thereof or even using a number of panels on one same column.

Figure 9:
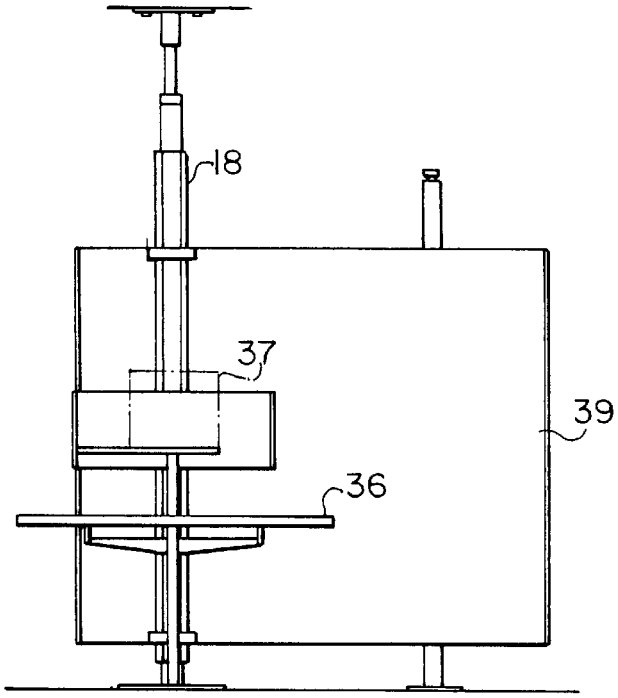
FIG. 9 is an elevation of a post for experimentation.
Figure 10:
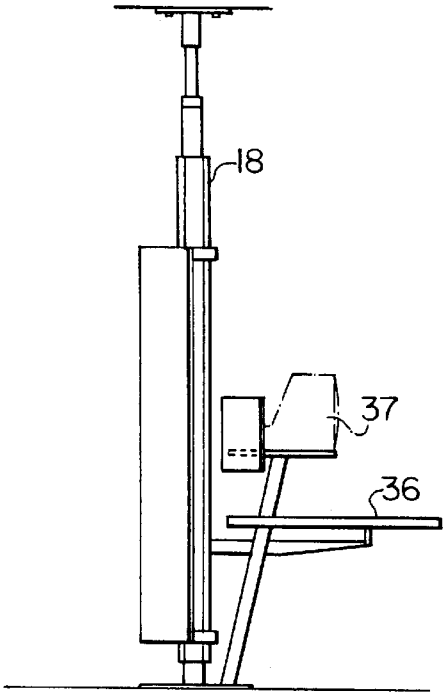
FIG. 10 is a side view of the object shown in FIG. 9.
Figure 11:
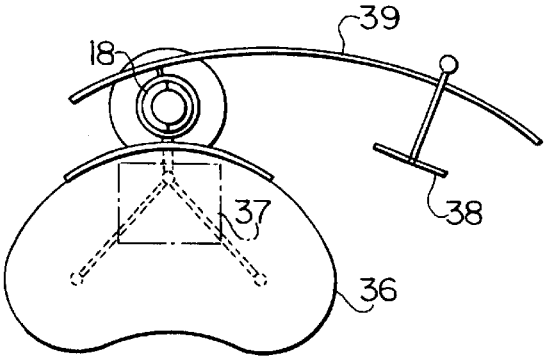
FIG. 11 is a plan view of the object shown in FIGS. 9 and 10.

FIGS. 9, 10, and 11 show the post for experimentation, consisting of a table 36 with a computer 37 and, if wished, a support for an additional monitor 38, all framed by a large curved panel 38.

Figure 12:
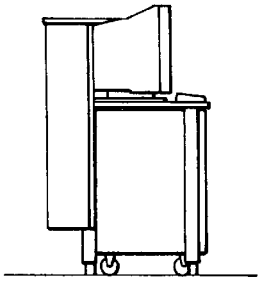
FIG. 12 is a side view of a post for assistance.
Figure 13:
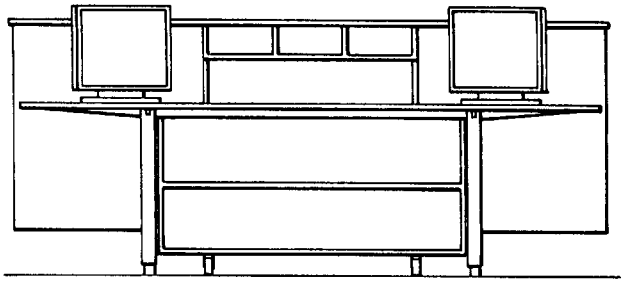
FIG. 13 is an elevation of the object shown in FIG. 12.
Figure 14:
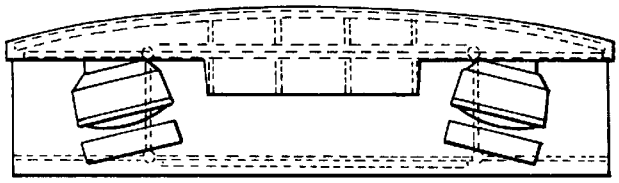
FIG. 14 is a plan view of the object shown in FIGS. 12 and 13.

FIGS. 12, 13, and 14 show a post for assistance 14, to which a client who has traversed the panels for presentation of service 7 and for emphasis 8 may resort in order to consult and clear up any doubts before passing to a post for experimentation 9.

Figure 15:
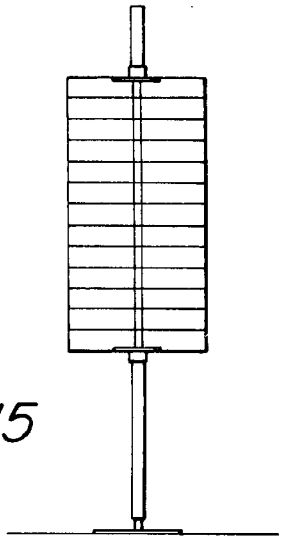
FIG. 15 is a side view of the directory of brands.
Figure 16:
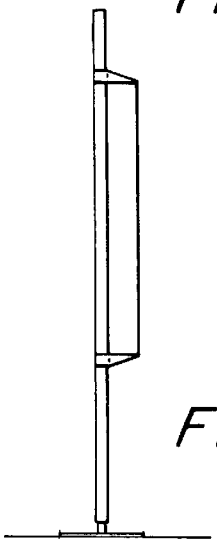
FIG. 16 is a side view of the object shown in FIG. 15.

The directory of brands 4 located at the side of the entrance or in a zone nearby is shown in FIGS. 15 and 16.

Figure 17:
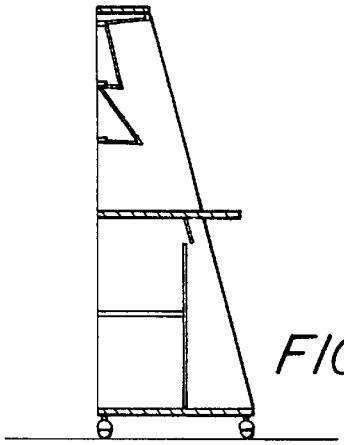
FIG. 17 is a side view of the equipment showcase.
Figure 18:
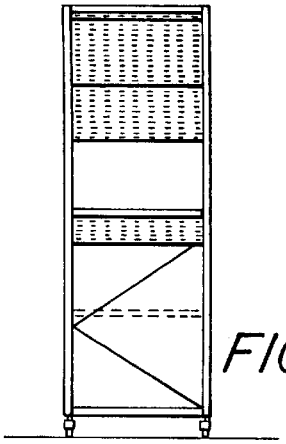
FIG. 18 is an elevation of the object shown in FIG. 17.

The equipment showcases 12 or modules for exhibition of available equipment, which the client may take from the showcase in order subsequently to formalize a contract or purchase at the post of assistance 14, are shown in FIGS. 17 and 18.

Figure 19:
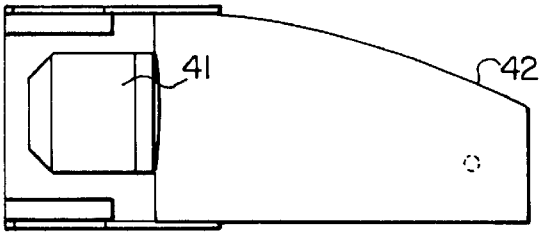
FIG. 19 is an elevation of a post for attention to clients.
Figure 20:
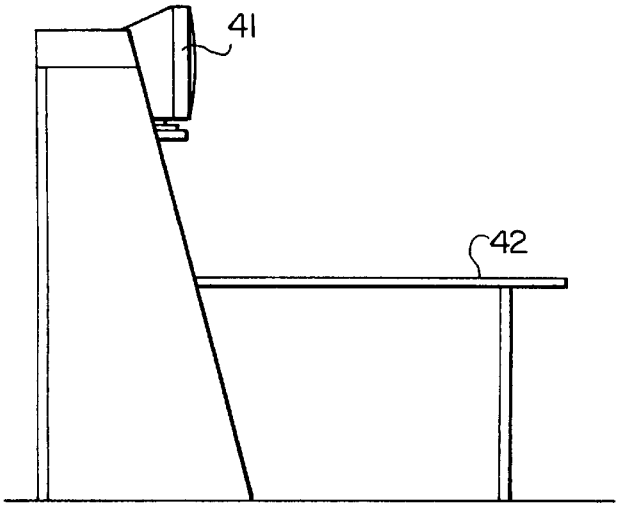
FIG. 20 is a side view of the object shown in FIG. 19.
Figure 21:
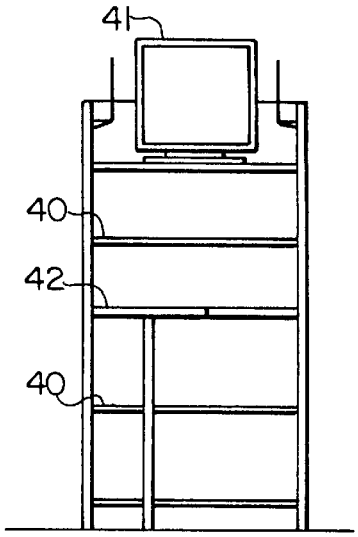
FIG. 21 is a plan view of the object shown in FIGS. 19 and 20.

FIGS. 19, 20, and 21 show a post for attention to clients with a series of informative shelves 40, a monitor 41 and an integral table 42 to permit clients who do not wish personalized attention at the corresponding post 16, nevertheless to feel adequately attended to.

Figure 22:
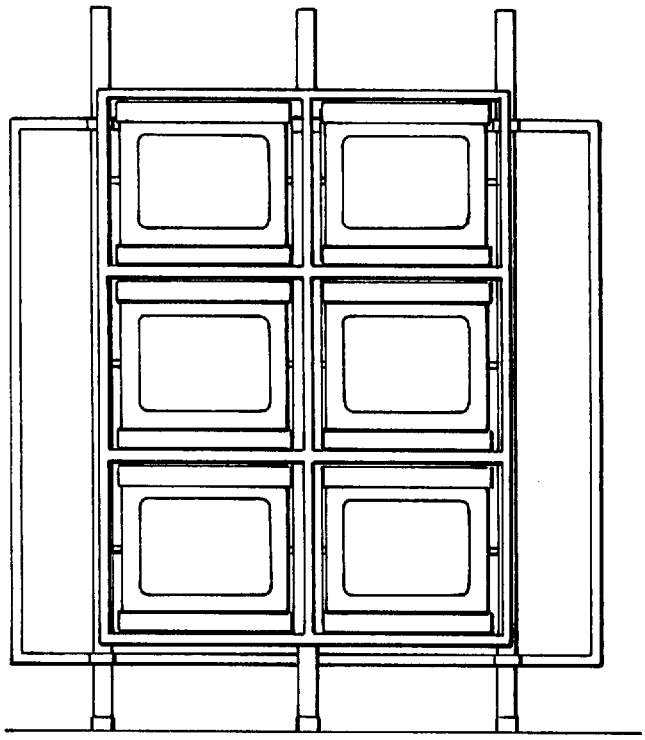
FIG. 22 is a side view of a monitor support.
Figure 23:
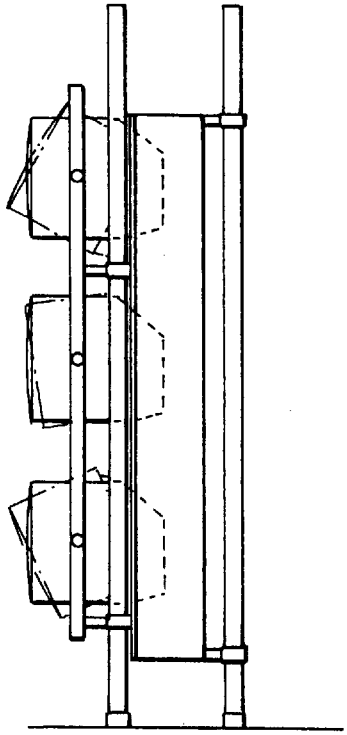
FIG. 23 is a side view of the object shown in FIG. 22.
Figure 24:
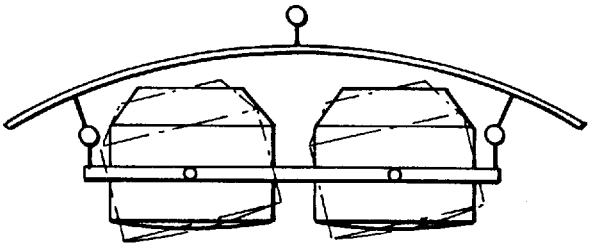
FIG. 24 is a plan view of the object shown in FIGS. 22 and 23.

The monitor support 3, which in this case holds six monitors and ancillary equipment to facilitate their movement in vertical ascent and descent and lateral left to right and vice versa, is shown in more detail in FIGS. 22, 23, and 24.

Figure 26:
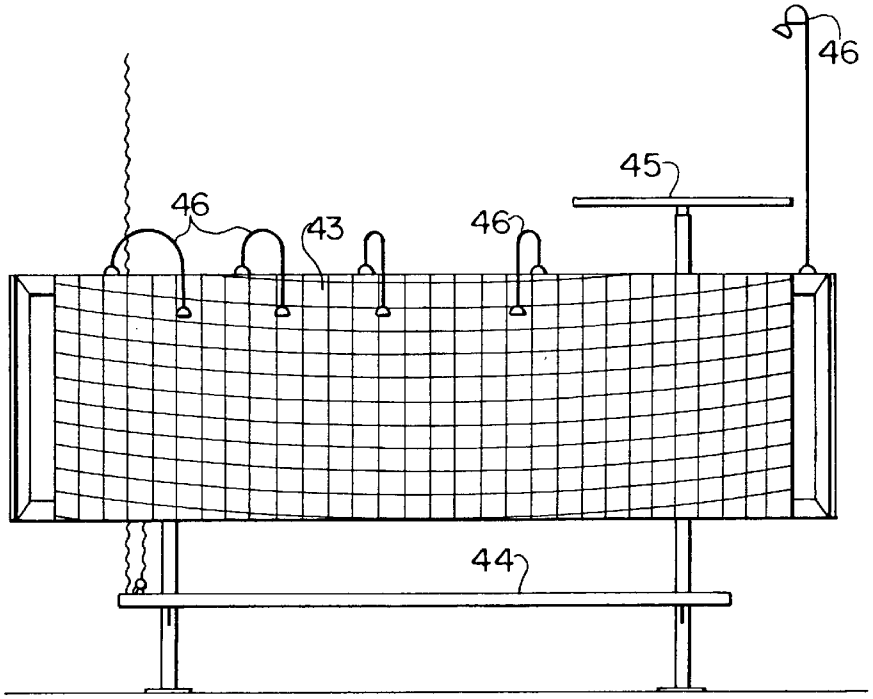
FIG. 26 is an elevation of the object shown in FIG. 25.
Figure 27:
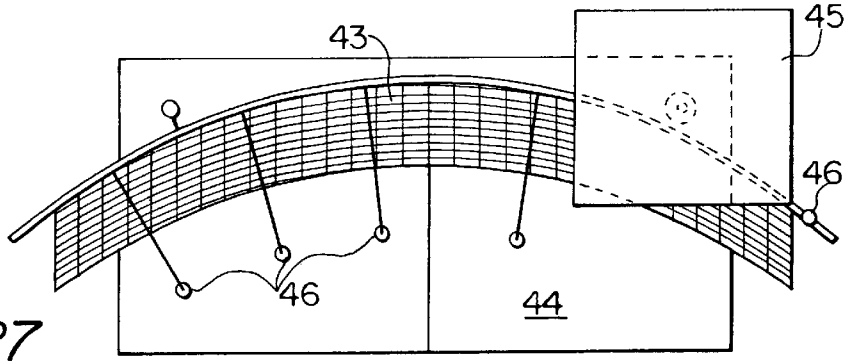
FIG. 27 is a plan view of the object shown in FIGS. 25 and 26.
Figure 25:
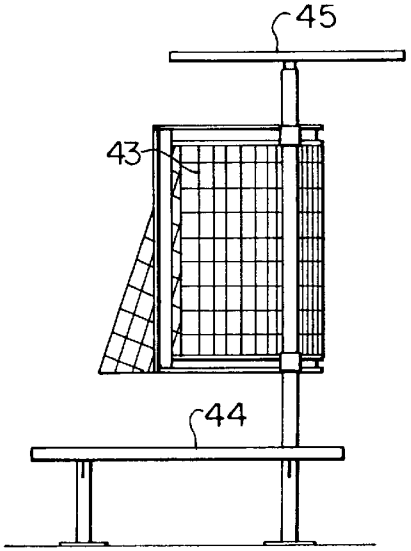
FIG. 25 is a side view of the equipment showcase in the facade.

The equipment showcase in the facade 2 is shown in FIGS. 25, 26, and 27, in which the showcase panel 43, the equipment support 44, properly stated, a swiveling support 45 for star products, and the light bulbs of the showcase 46 are shown.

Figure 28:
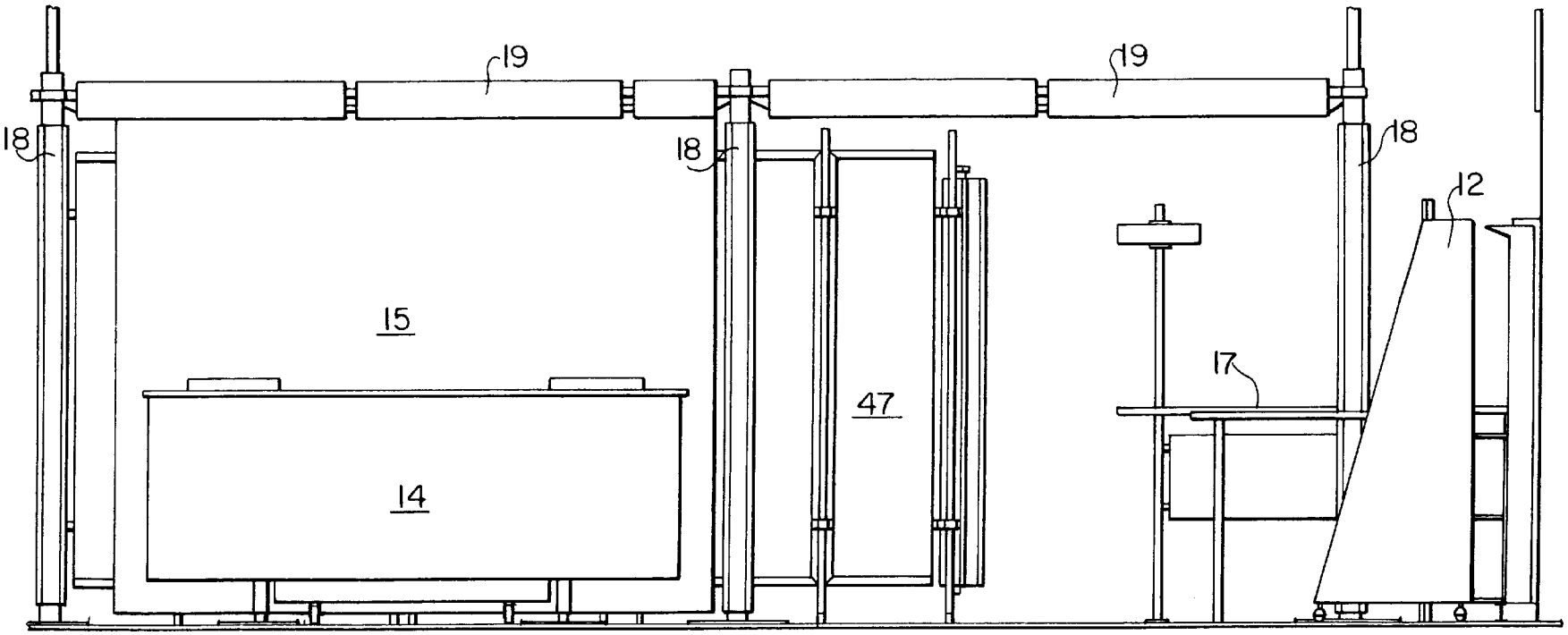
FIG. 28 is a general view of the zone of assistance, with the background corresponding to the logotype panel.
Figure 29:
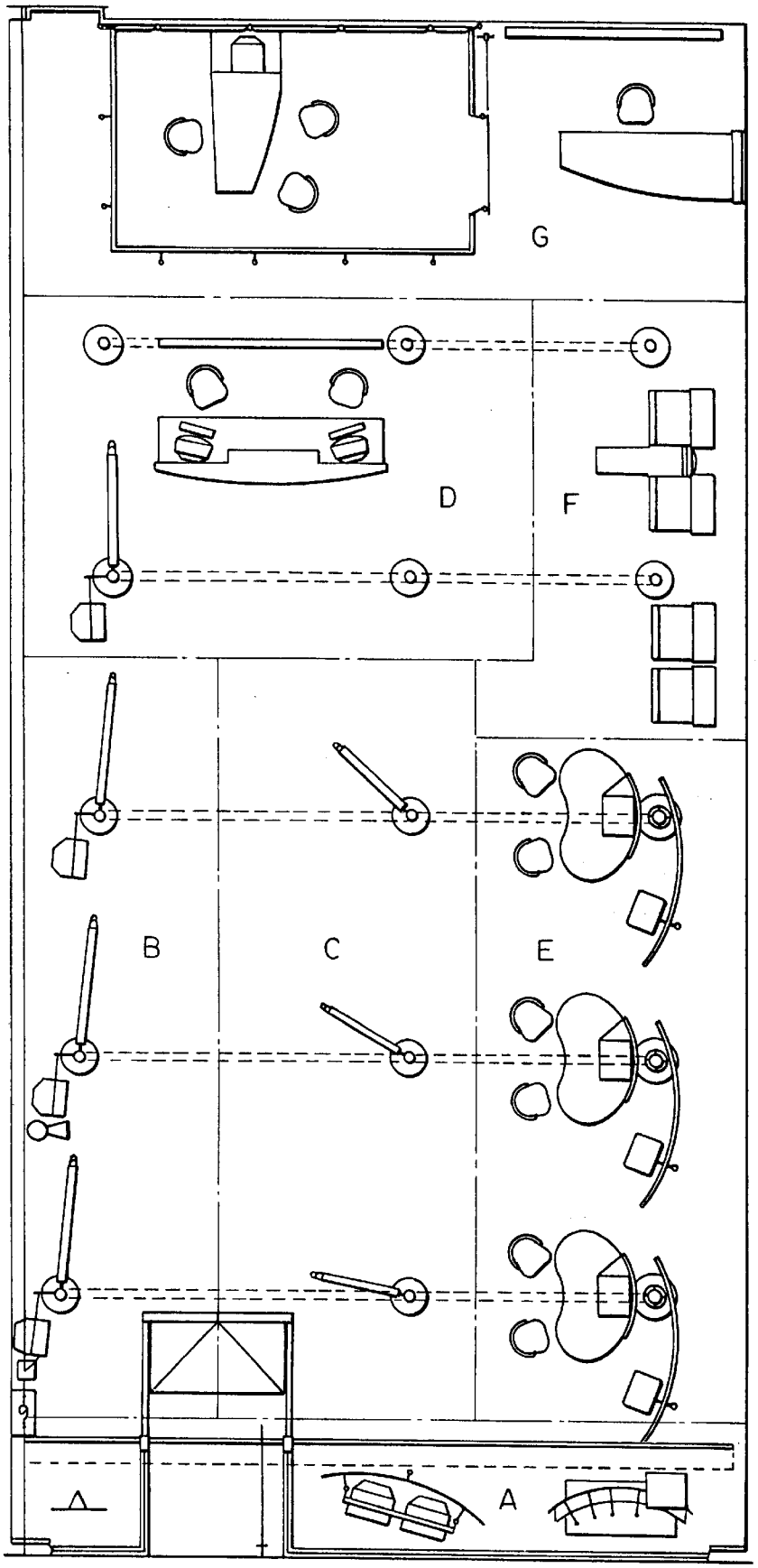
FIG. 29 Finally, shows a general view of the structuring by zones of the shop.
Figure 30:
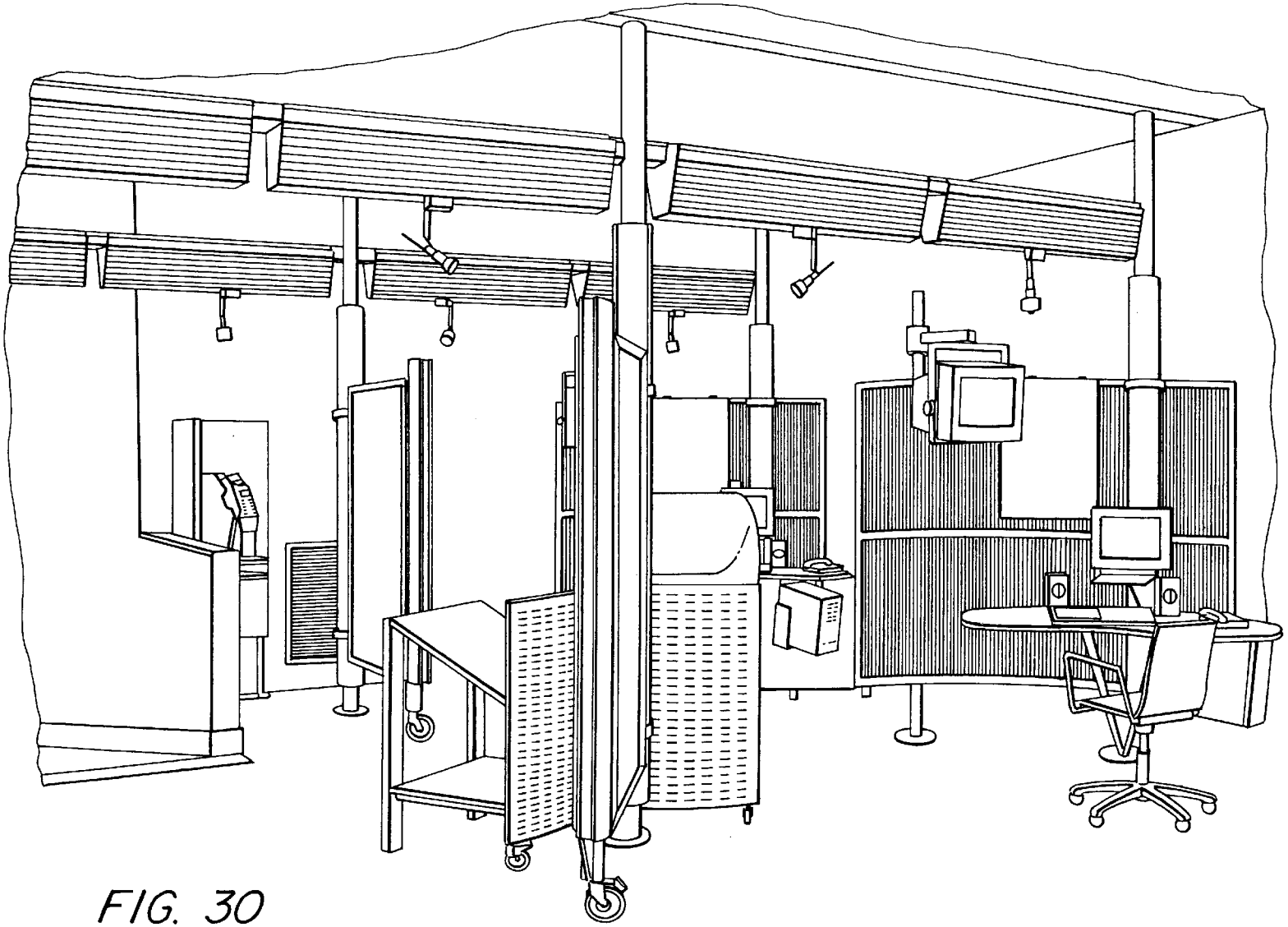
FIG. 30 is a perspective view of zones C and E shown in FIG. 29.
Figure 31:
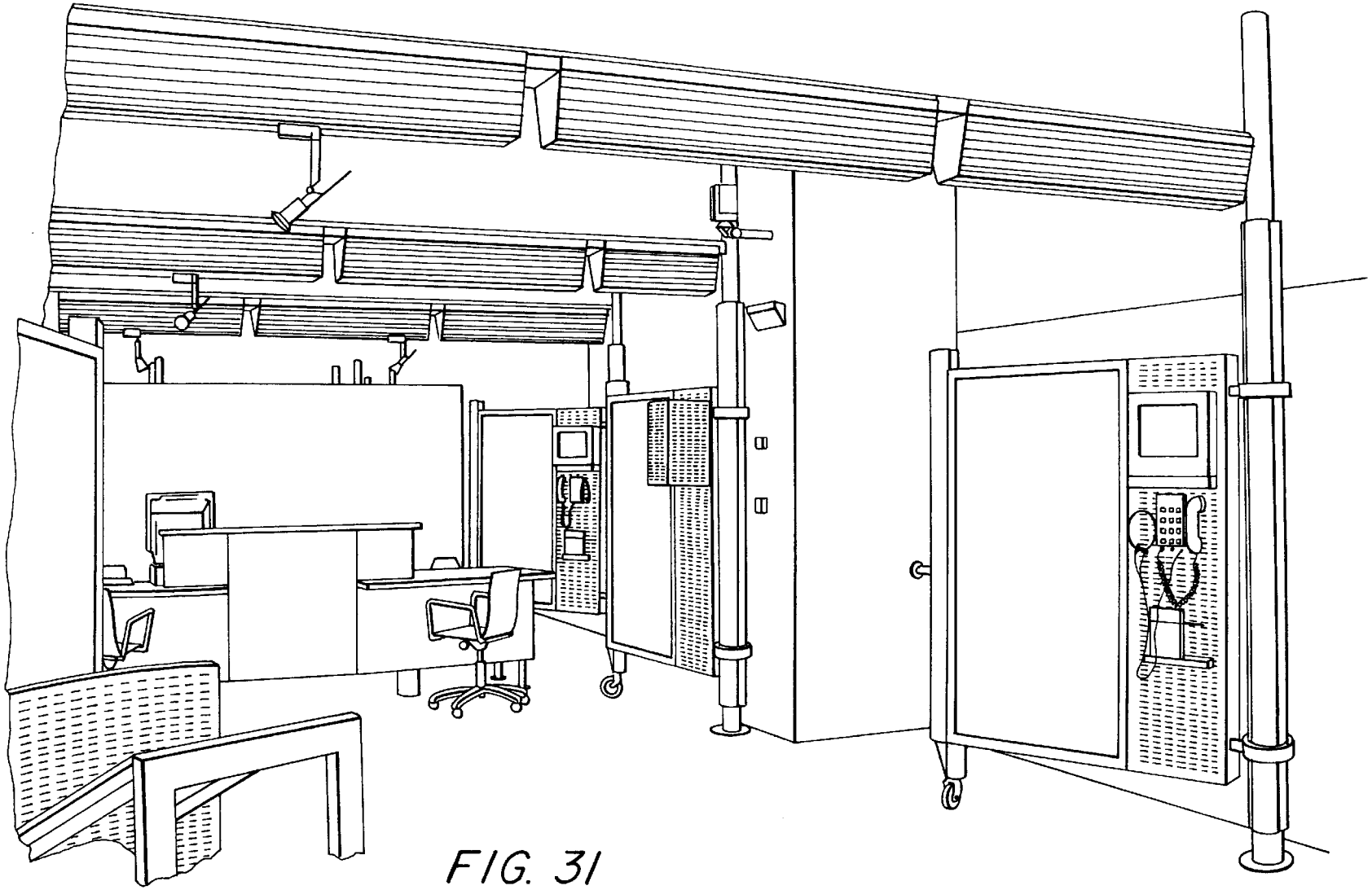
FIG. 31 is a perspective view of zone D shown in FIG. 29.
Figure 32:
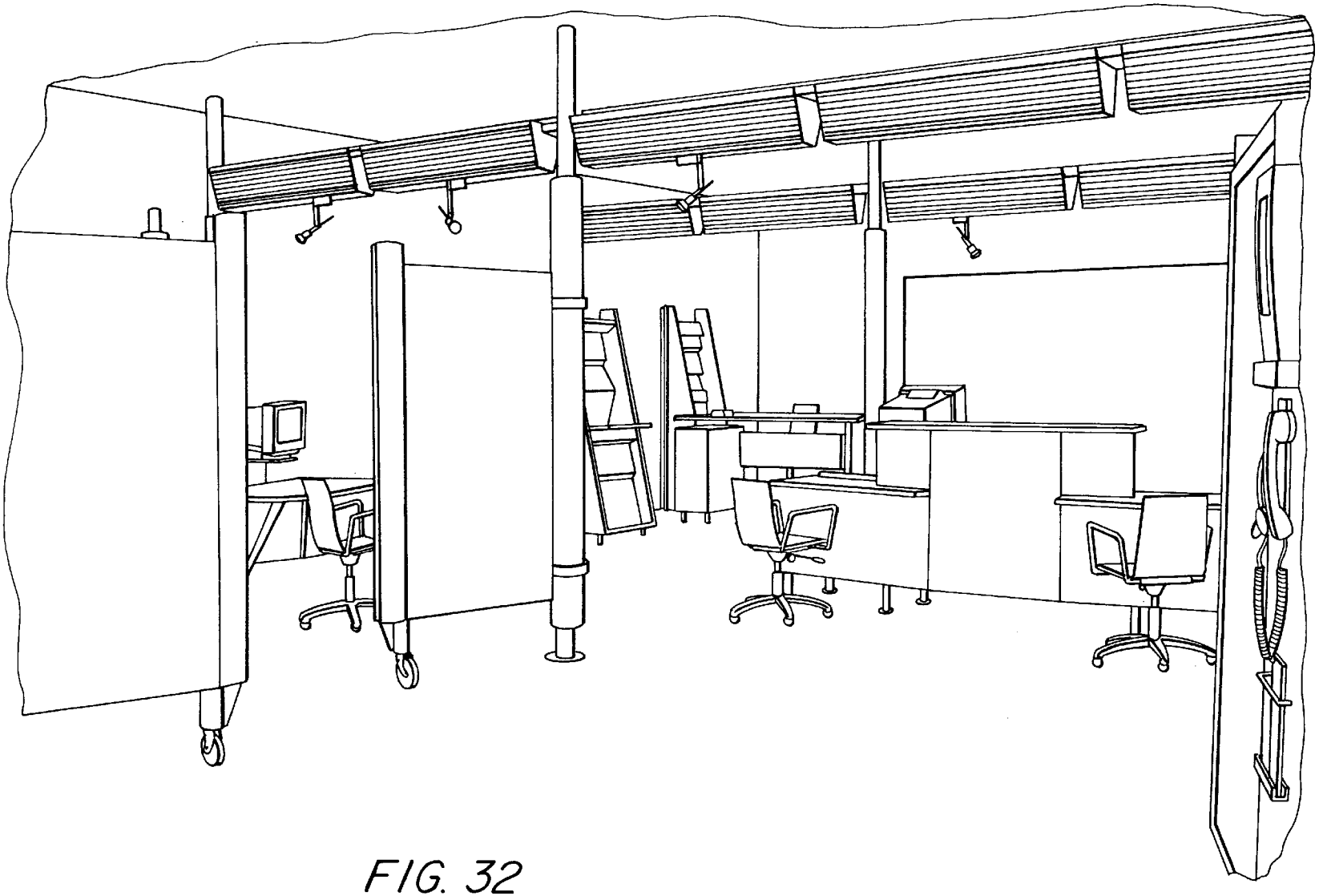
FIG. 32 is a perspective view of zones D and G shown in FIG. 29.
Figure 33:
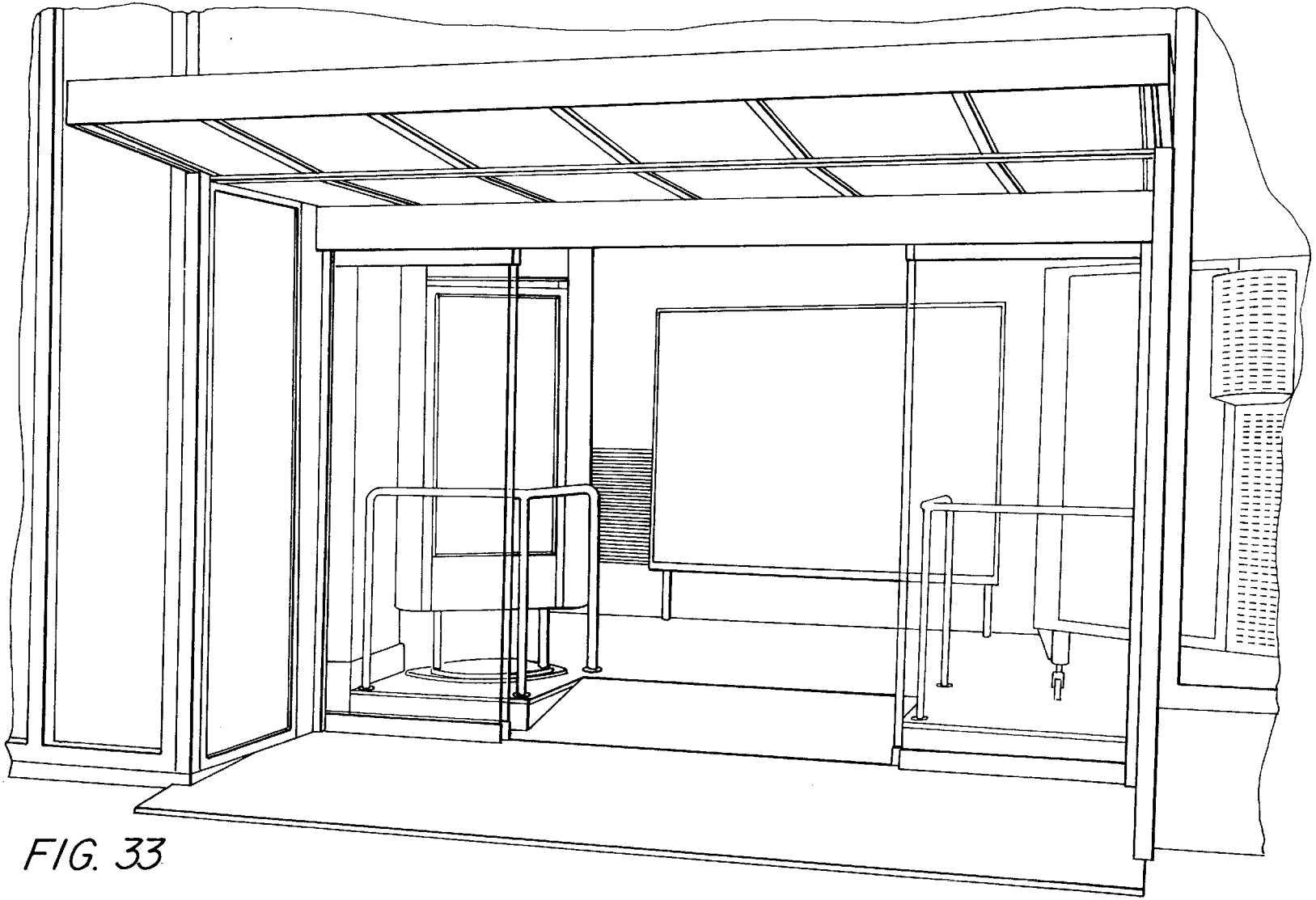
FIG. 33 is a partial perspective view of the facade shown in FIG. 3.

FIG. 28 is a general view of the zone at the rear of the shop, in which the post for assistance 14, with the logotype panel 15 behind it, the structure 47 of closure of the post 16 for personalized attention to clients 6, with no module attached, that is, with only the posts 18 and the supported illuminating beams 19, a post for attention to clients, and an equipment showcase.

With use of these elements or modules, the commercial establishment is structured in seven different areas, as reflected in FIG. 28, said classification not being by products or services, but by modes of attention to clients, to wit:

The cabinet A, at which the monitor support 3 and the equipment showcase in the facade 2 are located.

The area for presentation of services B or area for regular presentation of services.

The area for presentation of promotional services or emphasized services C, destined for extraordinary presentation of services.

The area for experimentation D, and which clients may learn how the various services offered operate.

The area for assistance E, at which the logotype panel 15 and the post for assistance 14 or zone for information and contracting of services are located.

The area for attention to clients F, at which clients are given attention adequate for their needs.

The area for exposition of equipment G, where the equipment being marketed and available to clients is exhibited.

Said structuring by areas of attention permit the public to circulate in the shop in the following manner. To wit:

1. The public is attracted by the facade/cabinet (Zone A), and decides to enter.

2. Following the normal access flow, the zone for presentation of services is at left (Zone B), while the zone for promotion or emphasis, at which clients may go deeper into the requirements for their satisfaction, is at right (Zone C).

3. This hallway ends at the zone for assistance (Zone D), to which clients are led so that they may formulate consultations and request explanations.

4. From this post, clients are directed to the zone for experimentation of services (Zone E), at which they may experience the possibilities offered by the services in which they are interested, to the area of personalized attention to clients (Zone F), or to the area of exposition of equipment (Zone G), each in accordance with his needs.

5. Clients finally return to the area or zone of assistance Zone C, where they may execute the purchase or other transaction of the service or equipment acquired.

This structuring of areas attempts, on the one hand, to simplify and orient clients during their visits to the shop in such manner as to make it as easy as possible for them to have access to their needs and to cause them to remember said structuring, which will be homogeneous in all establishments of this type, and on the other to focus and channel clients towards experimenting with and testing services and equipment which may in great measure be unknown to the general public.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. A system of internal modular structures creating an office environment divided into a plurality of functional areas, comprising:

a series of identical porticos arranged in repetitive succession, each portico comprising a plurality of spaced columns and at least one illuminating beam supported on the columns;

a cabinet, a monitor support located in the cabinet, and a plurality of monitors supported in the monitor support, the cabinet being located forwardly of the series of porticos;

a first area for the presentation of regular services to customers, the first area incorporating a first portion of the series of porticos;

a second area for the presentation of promotional services to customers, the second area incorporating a second portion of the series of porticos and being adjacent the first area;

a third area in which clients may learn how the various services offered operate, the third area being located rearwardly of the first and second areas;

a fourth area for providing information and assistance to clients, the fourth area incorporating a third portion of the series of porticos and being located adjacent the second area;

a fifth area for providing attention to clients, the fifth area being located adjacent the third area; and a sixth area for the exhibition of equipment to clients, the sixth area being located rearwardly of the third and fifth areas.

2. The system of claim 1, wherein the illuminating beams are attached to the columns.

3. The system of claim 1, wherein the illuminating beams are independent of the columns.

4. The system of claim 1, wherein:

each portico comprises left, right, and middle columns;

the first area comprises a plurality of first modules, and each first module includes:

a first panel divided into first and second zones and pivotably attached to the left column of one of the porticos, and a wheel supporting the first panel, thereby permitting a multiplicity of configurations by changing the angle at which the first panel is disposed relative to its respective portico, and wherein:

the first zone includes first and second sides capable of displaying posters on two sides, and fluorescent lights positioned to light the first zone; and the second zone includes a monitor, a telephone-type keyboard associated with the monitor, and a support for a pamphlet holder;

the second area comprises a plurality of second modules, and each second module includes a second panel having only a single zone and pivotably attached to the middle column of one of the porticos, and a wheel supporting the second panel, thereby permitting a multiplicity of configurations by changing the angle at which the second panel is disposed relative to its respective portico, and wherein:

the single zone includes first and second sides capable of displaying posters; and the third area comprises a plurality of third modules, and each third module includes a table configured to hold a computer processor and monitor, a support for an additional computer monitor adjacent the table, and a large curved panel framing the table and the support.

5. The system of claim 4, wherein at least some of the first modules include a plurality of first panels pivotably attached to the left column of one of the porticos.

6. The system of claim 4, wherein at least some of the second modules include a plurality of second panels pivotably attached to the middle column of one of the porticos.

7. The system of claim 5, wherein at least some of the second modules include a plurality of second panels pivotably attached to the middle column of one of the porticos.

8. The system of claim 1, further comprising a plurality of illuminating projectors hanging from the illuminating beams, and wherein each of the illuminating beams comprises:

upper and lower portions;

a plurality of fluorescent tubes located in the upper portion;

a tray positioned above the tubes for electric channels enclosing the passage of cables between modules;

a zone for passage of cables between modules located in the lower portion;

a ballast located in the upper portion above the tray;

an electrified rail for connecting the hanging projectors to the illuminating beam; and side walls at least partially enclosing the fluorescent tubes, the tray, and the zone for passage of cables, and the electrified rail, the side walls comprising two sheets of translucent material and a sheet of perforated material interposed between the sheets of translucent material.

9. The system of claim 1, wherein the porticos and the cabinet rest on a floor, said system further comprising:

spot lighting embedded in the floor along the system perimeter for providing perimeter ambient lighting; and a plurality of projector lights hanging from the illuminating beams.

* * * * *